US006930263B2

(12) United States Patent
Hung

(10) Patent No.: US 6,930,263 B2
(45) Date of Patent: Aug. 16, 2005

(54) SWITCH ASSEMBLY FOR ELECTRONIC APPLIANCES

(75) Inventor: Tsung-Yung Hung, Taipei (TW)

(73) Assignee: Averatec Asia Incorporation, Taipei Hsien (TW)

( * ) Notice: Subject to any disclaimer, the term of this patent is extended or adjusted under 35 U.S.C. 154(b) by 198 days.

(21) Appl. No.: 10/671,994

(22) Filed: Sep. 27, 2003

(65) Prior Publication Data

US 2005/0067265 A1 Mar. 31, 2005

(51) Int. Cl.[7] ..... H01H 27/06

(52) U.S. Cl. ..... 200/61.62; 200/333; 200/314; 361/681

(58) Field of Search ..... 200/313, 314, 200/318.2, 329, 61.7, 61.73, 61.62, 61.64, 61.66, 17 R, 43.18, 333; 361/680–683

(56) References Cited

U.S. PATENT DOCUMENTS

| | | | | | |
|---|---|---|---|---|---|
| 4,674,120 | A | * | 6/1987 | Heldenbrand | 379/427 |
| 4,995,650 | A | * | 2/1991 | Schantz et al. | 292/201 |
| 5,327,584 | A | * | 7/1994 | Adachi et al. | 455/575.8 |
| 5,396,396 | A | * | 3/1995 | Watanabe | 361/212 |
| 5,520,026 | A | * | 5/1996 | Ackland | 68/12.26 |
| 5,612,520 | A | * | 3/1997 | Toedtman et al. | 200/16 D |
| 5,728,985 | A | * | 3/1998 | Hapke et al. | 200/61.62 |
| 5,754,395 | A | * | 5/1998 | Hsu et al. | 361/680 |
| 6,150,622 | A | * | 11/2000 | Malnati | 200/61.62 |
| 6,191,938 | B1 | * | 2/2001 | Ohgami et al. | 361/681 |

* cited by examiner

*Primary Examiner*—Kyung S. Lee

(57) ABSTRACT

A switch assembly for a laptop computer includes a push member connected to the lid of the computer. An activation member is disposed to a base of the computer. A switch is located at a position where the activation member movably touches the switch when the lid is pivoted toward the base and the activation member is moved by a movement of the push member.

2 Claims, 7 Drawing Sheets

SWITCH ASSEMBLY FOR ELECTRONIC APPLIANCES

FIELD OF THE INVENTION

The present invention relates to a switch assembly used for electronic appliances such as laptop computers. The assembly includes a push member on the lid and an activation member with a switch in the base so that when the lid is in a closed position, the switch is activated by the activation member.

BACKGROUND OF THE INVENTION

A conventional switch assembly for a laptop computer 1 is shown in FIGS. 1 and 1*a*, and generally includes a switch 13 disposed on a top surface of the base 12 of the computer and projects from the top surface of the base 12. The switch 13 is located in such a way that when the lid 11 is pivoted toward the base 12, the switch 13 is pressed by the lid 11 so as to activate a pre-determined function such as the standby status or energy saving mode. Nevertheless, due to the exposed position on the top surface of the base 12, the switch 13 tends to be worn out or dust can be accumulated in the gap of the switch 13. This usually leads to malfunctions.

The present invention intends to provide a switch assembly for a laptop computer and the switch assembly improves the shortcomings of the conventional design.

SUMMARY OF THE INVENTION

In accordance with one aspect of the present invention, there is provided a switch assembly that comprises a push member connected to a lid of a computer and an activation member is disposed to a base of the computer. A switch is located in such a way that the activation member movably touches the switch when the activation member is moved by the push member.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
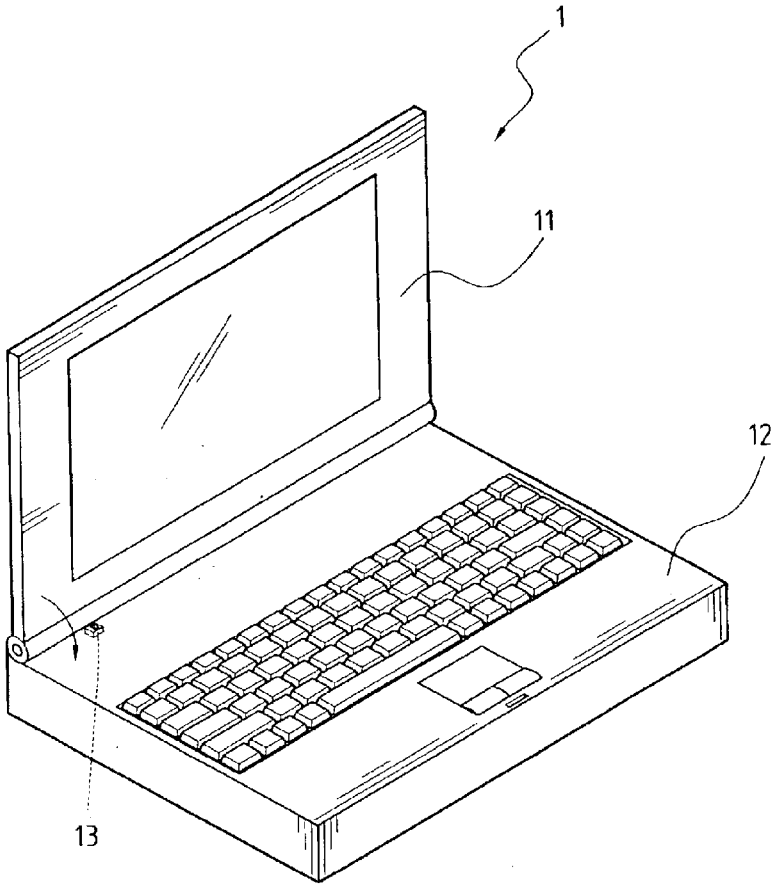
FIG. 1 (PRIOR ART)
FIG. 1 is a perspective view showing a conventional switch assembly on a laptop computer.
Figure 1A:
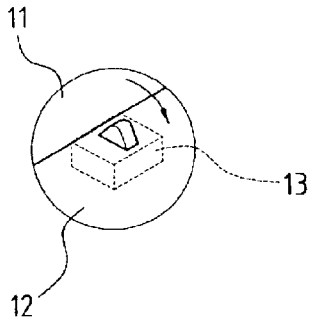
FIG. 1a (PRIOR ART)
FIG. 1*a* shows a switch to be pressed by a lid of the laptop computer.
Figure 2:
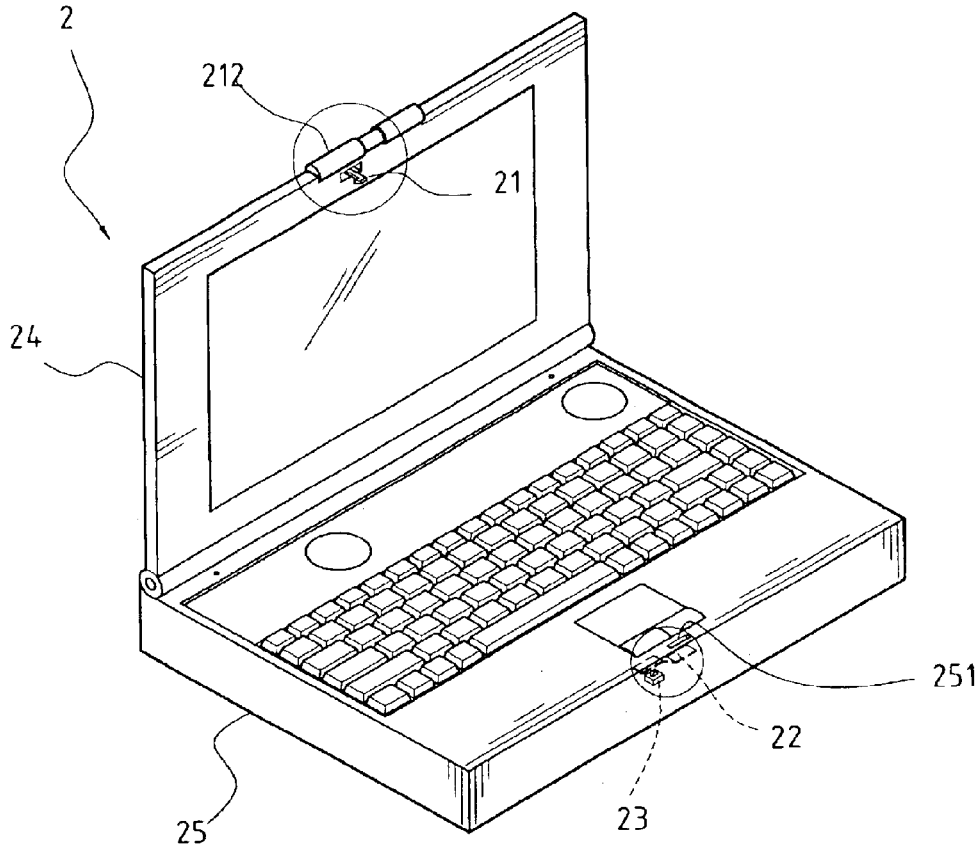
FIG. 2 is a perspective view showing a switch assembly of the present invention on a laptop computer.
Figure 2A:
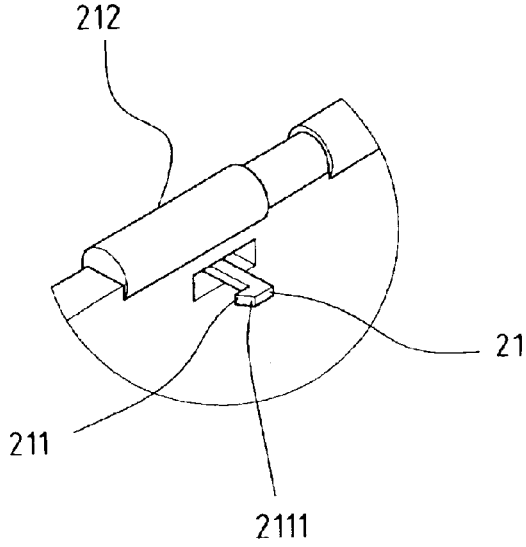
FIG. 2*a* shows a push member on a lid of the computer.
Figure 2B:
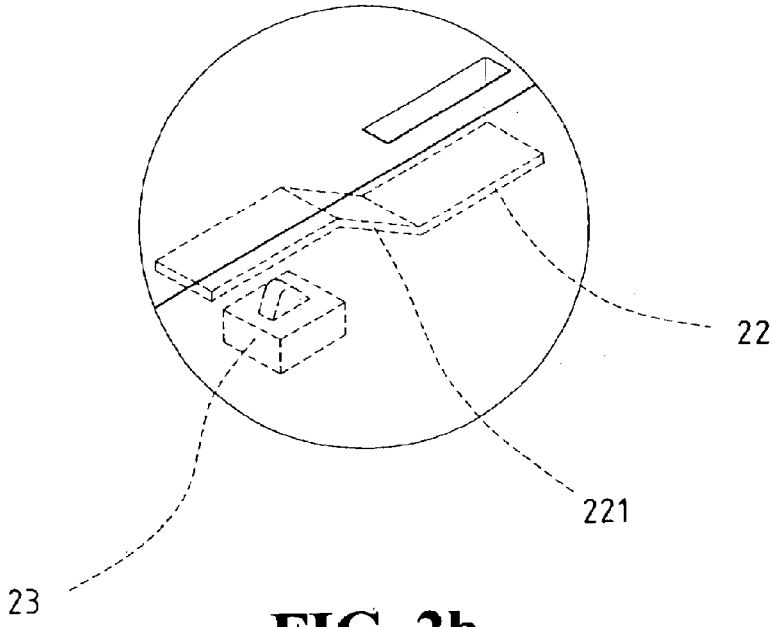
FIG. 2*b* shows an activation member and a switch in a base of the computer.

Referring to FIGS. 2, 2*a* and 2*b*, a switch assembly for an electronic appliance, such as a laptop computer 2, of the present invention comprises a push member 21 connected to a lid 24 of the laptop computer 2 which is connected to an operation button 212 on the lid 24. A spring, which is not shown in the drawings, is biased between the operation button 212 and the push member 21 so as to maintain the position of the push member 21. A head piece 211 is connected to a distal end of the push member 21 and includes an inclined surface 2111.

An activation member 22 is disposed to a base 25 of the laptop computer 2. The activation member 22 is a plate comprising two horizontal portions and an inclined portion 221 connected between the two horizontal portions. The inclined surface 2111 of the head piece 211 has the same slope of inclination as the inclined portion 221 of the activation member 22.

A switch 23 is disposed in the base 25 and located at a position where the activation member 22 movably touches the switch 23 when the activation member 22 is moved by a movement of the push member 21.

Figure 3A:
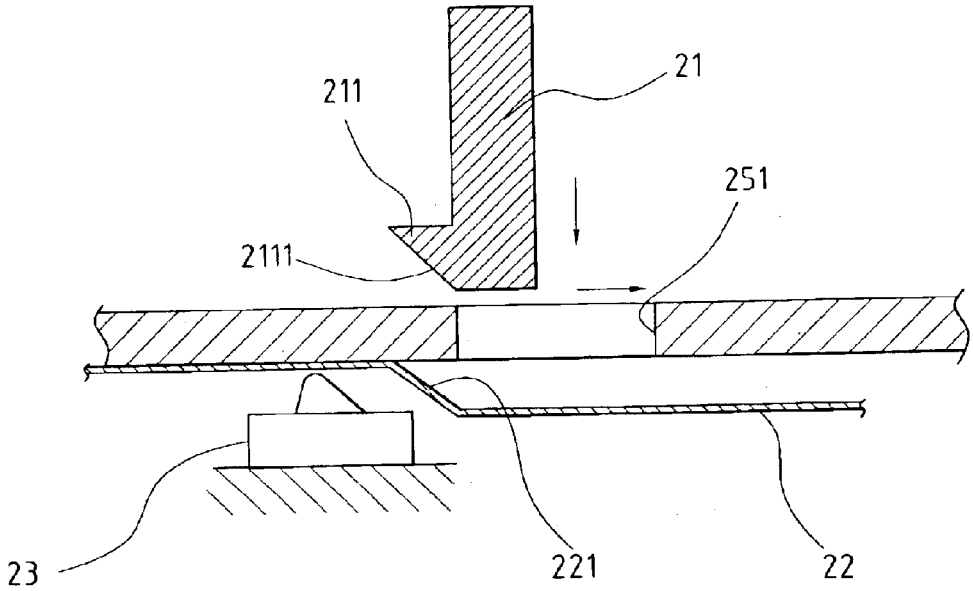
FIG. 3*a* shows the push member is shifted aside before it is inserted into the base of the computer.
Figure 3B:
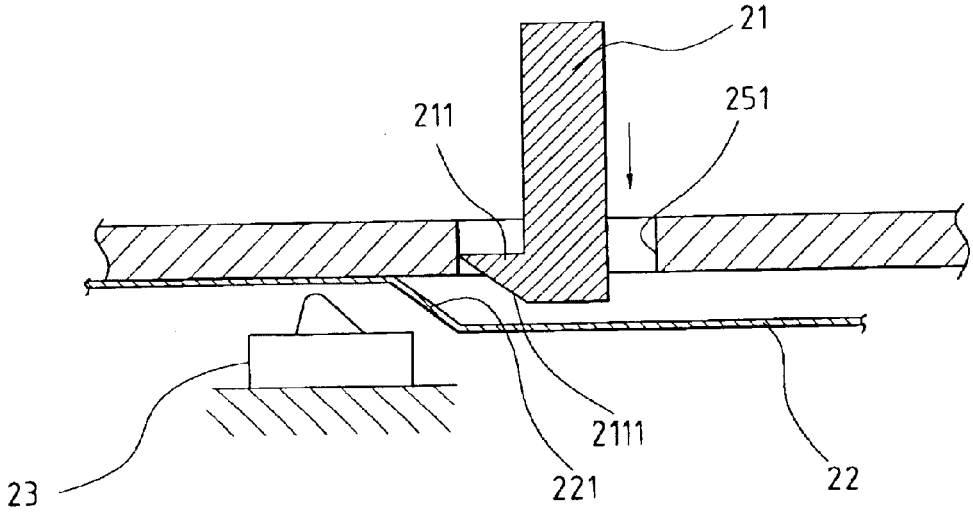
FIG. 3*b* shows the push member is inserted into the base of the computer.
Figure 3C:
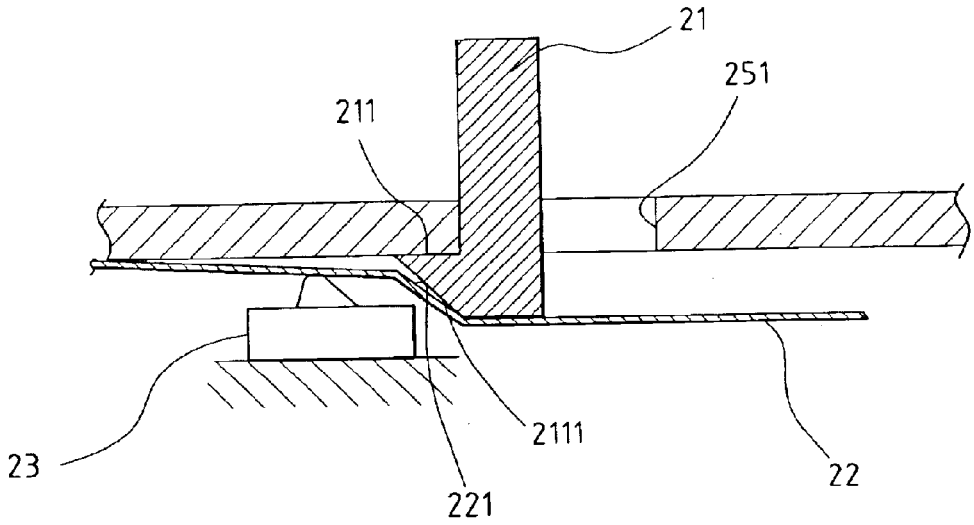
FIG. 3*c* shows the push member is released and moves to touch the activation member which presses the switch.
Figure 4:
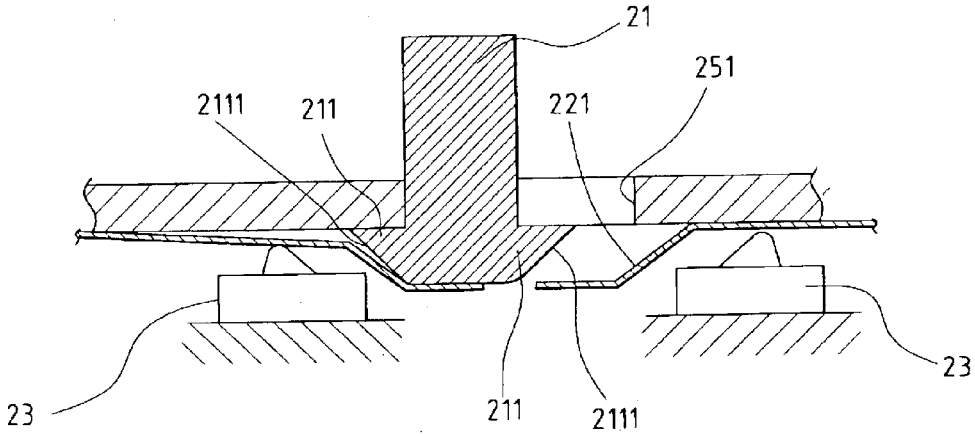
FIG. 4 shows there are two sets of activation member and switch in the base.
Figure 5:
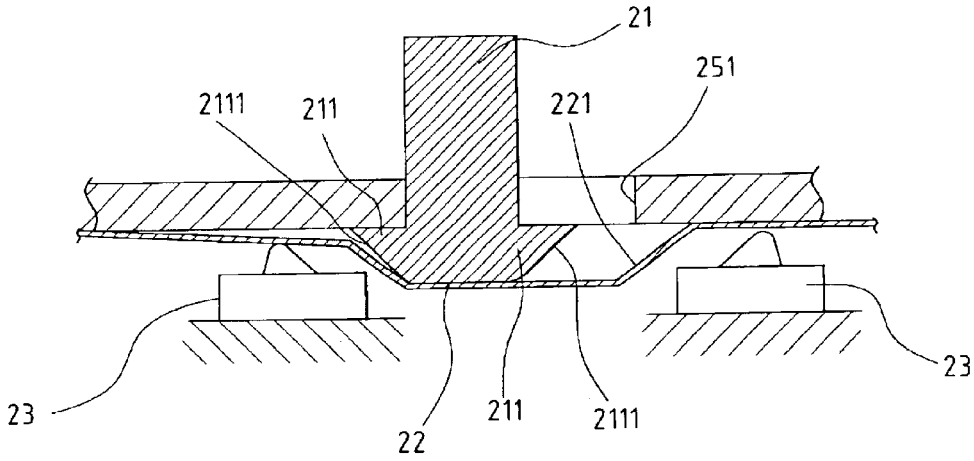
FIG. 5 shows the two activation members in FIG. 4 are made to be a one-piece member.

As shown in FIGS. 3*a*, 3*b* and 3*c*, the push member 21 is shifted aside by pushing and holding the operation button 212 before the lid 24 is to be closed by pivoting the lid 24 toward the base 25. The push member 21 is then inserted through a hole 251 in the base 25 and when the operation button 212 is released, the push member 21 is moved toward the inclined portion 221 of the activation member 22. The inclined surface 2111 pushes the inclined portion 221 of the activation member 22 to press the switch As shown in FIG. 4, there may have two sets of activation members 22 and switches 23 in the base 25, and the push member 21 has two inclined surfaces 2111 in the head piece 211 so as to optionally activate either one of the two switches 23. As shown in FIG. 5, the two activation members 22 as shown in FIG. 4 can also be made to be a one-piece member.

Figure 6:
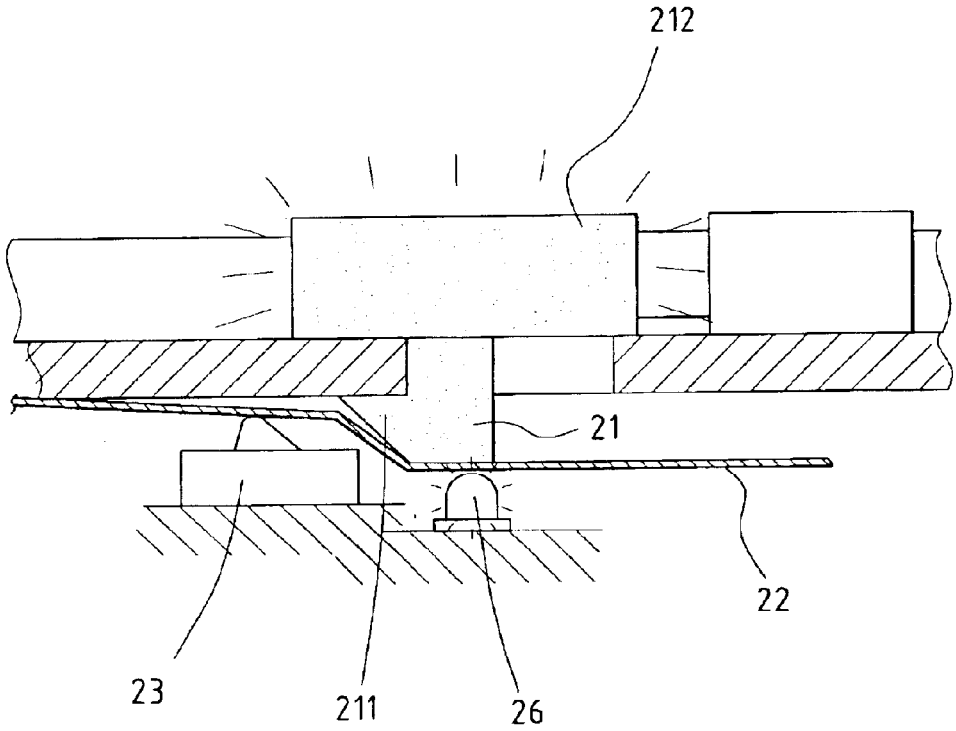
FIG. 6 shows a light device is located beneath the activation member and the operation button has a light device received therein.

As shown in FIG. 6, a light device 26 is located beneath the activation member 22 and is activated when the switch 23 is touched by the activation member 22. Another light device which is not shown is disposed in the operation button 212 so that when the switch 23 is touched, the operation button 212 lights up to let the user know that the switch is activated.

While we have shown and described the embodiment in accordance with the present invention, it should be cleat to those skilled in the art that further embodiments may be made without departing from the scope of the present invention.

What is claimed is:

1. A switch assembly for an electronic appliance, comprising:

a push member movably connected to a lid of the electronic appliance, said push member having a distal end with an inclined portion;

an upper through hole formed through a base of the electronic appliance;

an activation member disposed within said base, said activation member having an upper horizontal portion and a lower horizontal portion connected by an inclined portion substantially matched with said inclined portion of said push member;

a switch disposed below said upper horizontal portion of said activation member;

wherein said inclined portion of said distal end is engaged with said inclined portion of said activation member and said upper horizontal portion of said activation member is lowered to activate said switch when said distal end of said push member is pressed on said lower horizontal portion of said activation member through said upper through hole.

2. The switch assembly for an electronic appliance according to claim 1, further comprising a light device beneath said activation member, wherein said light device is turned on when said push member activates said switch.

* * * * *